US006408902B1

(12) United States Patent
Liau

(10) Patent No.: US 6,408,902 B1
(45) Date of Patent: Jun. 25, 2002

(54) BALLOON-INFLATING DEVICE

(76) Inventor: Ting Chau Liau, PO Box 82-144, Taipei (TW)

( * ) Notice: Subject to any disclaimer, the term of this patent is extended or adjusted under 35 U.S.C. 154(b) by 0 days.

(21) Appl. No.: 09/881,069

(22) Filed: Jun. 15, 2001

(51) Int. Cl.[7] ..... B65B 1/04; B65B 3/04; B67C 3/00

(52) U.S. Cl. ..... 141/313; 141/37; 141/47; 141/67; 141/95; 141/105; 141/313; 141/314; 141/317

(58) Field of Search ..... 141/37, 38, 47, 141/67, 94, 95, 96, 99, 100, 104, 105, 113, 114, 192, 313, 317, 392

(56) References Cited

U.S. PATENT DOCUMENTS 3,191,801 A * 6/1965 Standish ..... 221/14
3,380,490 A * 4/1968 Ellenberg et al. ..... 141/167
3,643,677 A * 2/1972 Begleiter ..... 137/113
3,670,860 A * 6/1972 Allison ..... 222/16

* cited by examiner

*Primary Examiner*—Timothy L. Maust
(74) *Attorney, Agent, or Firm*—Leong C. Lei

(57) ABSTRACT

A balloon-inflating device capable of mixing a multiple type of gases, which includes a body having an air-inlet cavity and a compression cavity; at least one air pump mounted to the body to pump air from the air-inlet cavity to the compression cavity; at least an air nozzle mounted to the body and having an air-inlet connected to the compression cavity, wherein the nozzle is provided with a stopper to seal the air-inlet in normal operating condition; at least a second gas supply valve having an air-outlet connected to the air nozzle and having an air-inlet connected to a second gas supplier; and a control device for controlling the operation of the air pump and the second gas supply valve, thereby the opening and closing of the air pump and the second gas supply valve inflate a balloon with either air or a second gas, or a mixture of the compressed air of the air pump and the second gas.

4 Claims, 6 Drawing Sheets

BALLOON-INFLATING DEVICE

BACKGROUND OF THE INVENTION (a) Field of the Invention

The present invention relates to a balloon-inflating device, and in particular, a device which pumps air or a second gas or a mixed gas to a balloon.

(b) Description of the Prior Art

During festive seasons, a plurality of balloons are inflated to decorate a venue or a room. However, due to the great number of balloons needed, the volume of gas used for inflating balloons is large and, in normal situation, helium gas is used as it is lighter than air and the balloons can float in the air. However, helium gas is an expensive gas. If the balloons are not to place afloat in the air, atmospheric air can be used to fill the balloons, or a mixed air and helium gas is used so as to cut the cost of the expensive helium gas. Accordingly, it is an object of the present invention to provide a balloon-inflating device, which can provide air, or a second gas to inflate balloons and thus the cost of balloons inflation is greatly reduced.

SUMMARY OF THE INVENTION

Accordingly, it is an object of the present invention to provide a balloon-inflating device capable of mixing a multiple type of gases to a balloon, wherein the device comprises a body having an air-inlet cavity and a compression cavity; at least one air pump mounted to the body to pump air from the air-inlet cavity to the compression cavity; at least an air nozzle mounted to the body and having an air-inlet connected to the compression cavity, wherein the nozzle is provided with a stopper to seal the air-inlet in normal operating condition; at least a second gas supply valve having an air-outlet connected to the air nozzle and having an air-inlet connected to a second gas supplier; and a control device for controlling the operation of the air pump and the second gas supply valve, thereby the opening and closing of the air pump and the second gas supply valve inflate a balloon with either air or a second gas, or a mixture of the compressed air of the air pump and the second gas.

Yet another object of the present invention is to provide a balloon-inflating device, wherein the air pump is mounted to the partition board of the body, and the air-inlet is extended into the air-inlet cavity and the air-outlet is in communication with the compression cavity.

A further object of the present invention is to provide a balloon-inflating device, wherein the air nozzle includes a base seat mounted across the bottom end of the top cover, and a recess being formed at a downward-facing shaft of the top end, and an air-inlet passed through the recess and a screw hole being provided to the circumferential edge of the bottom seat; a top nozzle section having a bottom end mounted across the top cover and tightly fasten the top section of the bottom seat, a communication hole being provided to the top nozzle section so as to communicate with the air inlet of the bottom seat; and a stopper mounted across the bottom section of the recess to seal the top end of the air-inlet so as to block the air from the second gas supplier connected to the second gas supply valve from entering the compression cavity.

Other object and advantages of the present invention will become more apparent from the following description taken in conjunction with the accompanying drawing.

DETAILED DESCRIPTION OF THE PRESENT INVENTION

Figure 1:
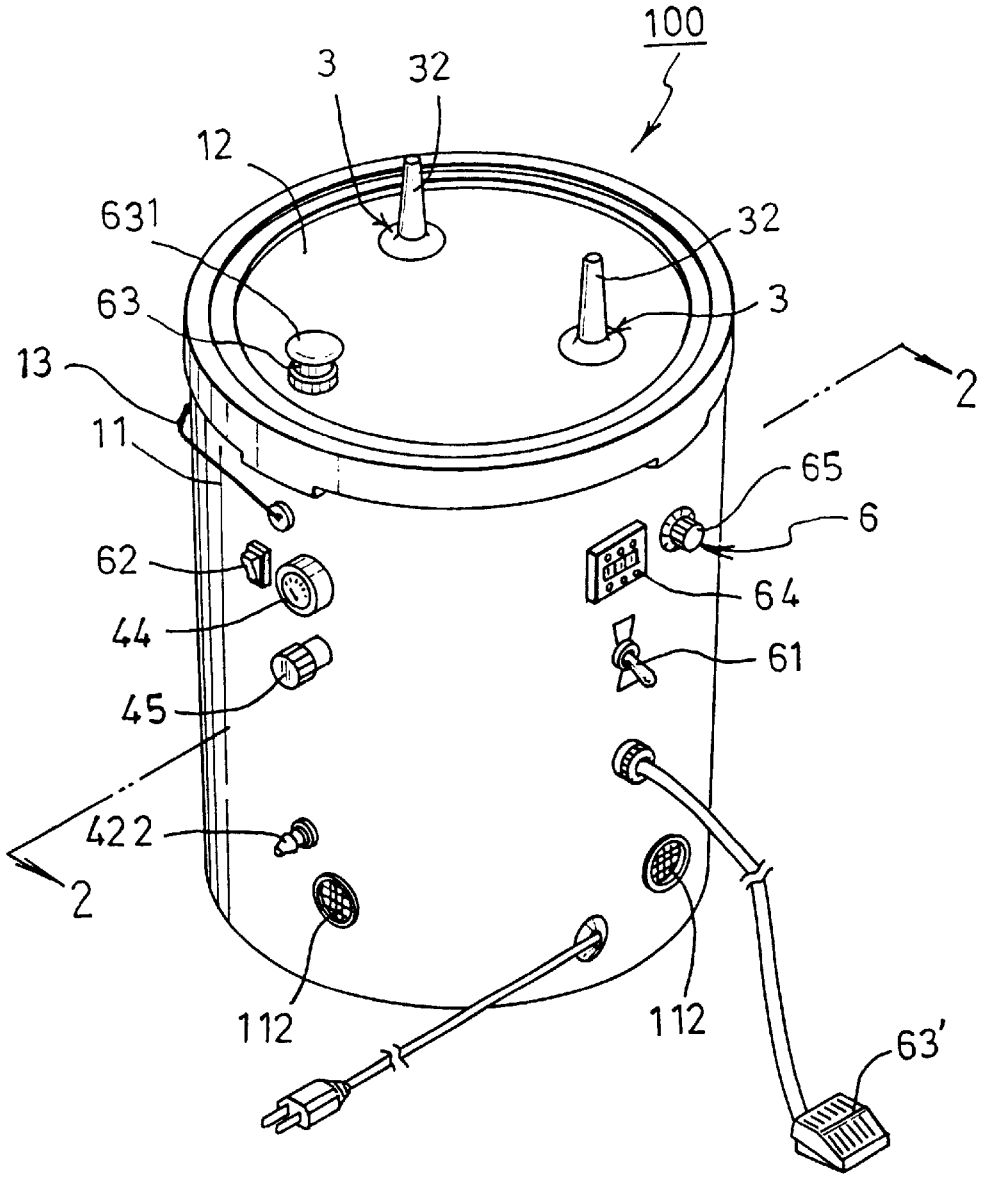
FIG. 1 is a perspective view of the present invention.

Referring to FIGS. 1 to 5, there is shown a balloon-inflating device 100 capable of mixing a multiple type of gases. The device 100 comprises a body 1 having an air-inlet cavity 10*a* and a compression cavity 10*b;* at least one air pump 2 mounted to the body 1 to pump air A from the air-inlet cavity 10*a* to the compression cavity 10*b;* at least an air nozzle 3 mounted to the body 1 and having an air-inlet 312 connected to the compression cavity 10*b,* wherein the nozzle 3 is provided with a stopper 33 to seal the air-inlet 312 in normal operating condition; at least a second gas supply valve 4 having an air-outlet 411 connected to the air nozzle 3 connected to a second gas supplier 5 (such as helium, or compressed gas from a cylinder tank); and a control device 6 for controlling the operation of the air pump 2 and the second gas supply valve 4, thereby the opening and closing of the air pump 2 and the second gas supply valve 4 inflate a balloon 7 with either air or a second gas, or a mixture of the compressed air of the air pump 2 and the second gas. Thus, the cost of balloon-inflation is greatly reduced as the usage for the second gas is reduced.

Figure 2:
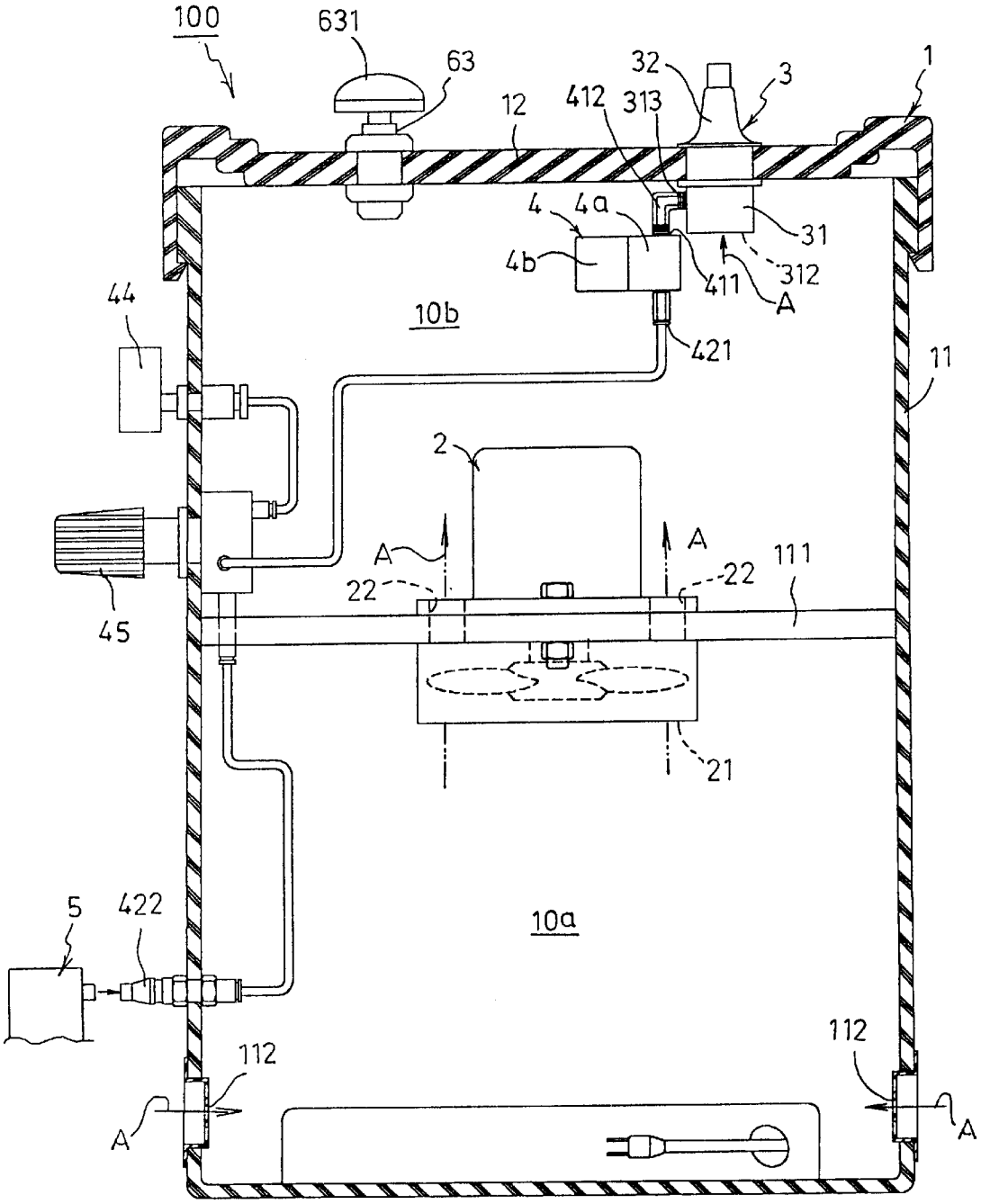
FIG. 2 is a sectional view along line 2—2 of FIG. 1.

As shown in FIGS. 1 and 2, the body 1 includes a hollow cylindrical body 11 having a partition board 111 position at the center thereof to divide the cylindrical body 11 into the air-inlet cavity 10*a* and the compression cavity 10*b,* at least an air-inlet hole 112 being provided to the circumferential edge of the air-inlet cavity 10*a* corresponding to the hollow cylindrical body 11 to lead the external air; and a top cover 12 to sealingly fasten an opening 10 at the top of the hollow cylindrical body 1.

In accordance with the present invention, the body 1 is a cylindrical shape or can be modified into other shapes. Further, handles 13 are provided to the two lateral sides of the body 1 and are corresponding to each other to facilitate the carrying of the body 1.

In accordance with the present invention, the air pump 2 is mounted to the partition board 111 of the body 1, and the air-inlet 21 is extended into the air-inlet cavity 10*a* and the air-outlet 22 is in communication with the compression cavity 10*b*.

The air nozzle 3 includes a base seat 23 mounted across the bottom end of the top cover 12, and a recess 311 being formed at a downward-facing shaft of the top end, and an air-inlet 21 passed through the recess 311 and a screw hole 313 being provided to the circumferential edge of the bottom seat 23; a top nozzle section 25 having a bottom end mounted across the top cover 12 and tightly fasten the top section of the bottom seat 23, a communication hole 321 being provided to the top nozzle section 25 so as to communicate with the air inlet 421 of the bottom seat 23; and a stopper 33 mounted across the bottom section of the recess 311 to seal the top end of the air-inlet 421 so as to block the air from the second gas supplier 5 connected to the second gas supply valve 4 from entering the compression cavity 10*b*.

The second gas supply valve 4 includes a valve body 4*a* having an air-outlet path through the center thereof, the air-outlet connected to a connector 412 so as to join a screw hole 321 at the base seat 23 of the air nozzle 2, and an air-inlet path being provided to the valve body 4*a,* the air-inlet being connected to a connecting head 422 so as to connect to the second gas supplier 5; and an electromagnetic valve 4*b* sealingly mounted at a lateral side of the valve body 4*a,* the electromagnetic valve 4*b* having a valve rod 43 with a front end sealingly mount the inlet of the air-outlet path to block the path between the air-inlet path of the valve body and the air-outlet path of the valve body 4*a.*

In accordance with the balloon-inflation device of the present invention, a throttle valve 45 and a pressure gauze 44 are provided between the second gas supplier 5 and the second gas supply valve 4.

In accordance with the present invention, the control device includes a main switch 61; a second gas control switch 62 to control the opening and closing of the second gas supply valve 4; a moving switch 63 to control the action of the pumps 2; a timer 64 to control the individual pump 2 action and the time of opening of the second gas supply valve 4; and a gas pump regulator 65 to control the rotation speed of the individual air pump 2 so as to control the air pressure of the individual air pump 2 entering the compression cavity 10*b.* The moving switch 63 includes an indicator 631 which is lighted in the course of balloon-inflation and is unlighted if the pump 2 stops operation.

The moving switch 63 is connected in series with a pedal-type moving switch 63', to proceed with inflation of the balloon 7.

Figure 3:
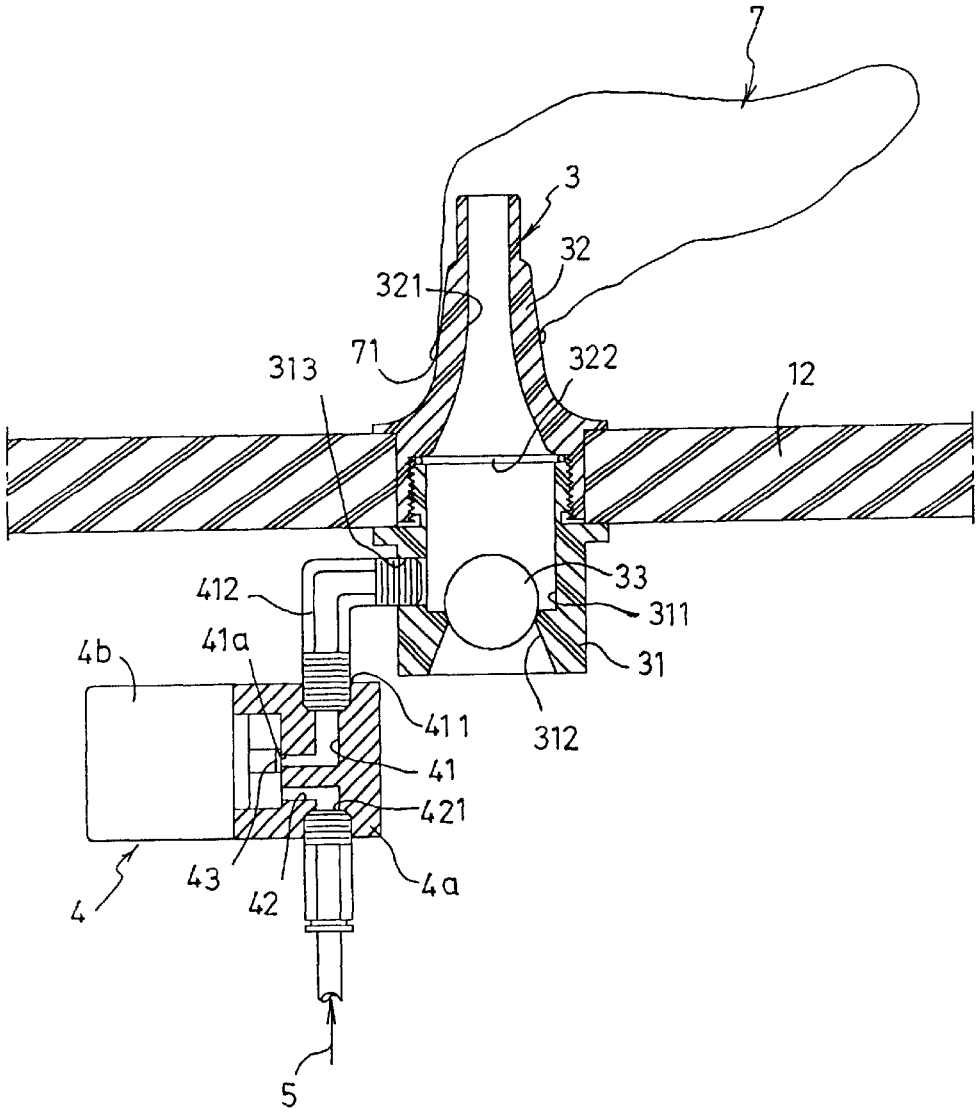
FIG. 3 is a schematic view of the present invention before inflating a balloon.

Referring to FIGS. 1, 2, 3, at normal condition, the air pump 2 stops compressing air B from the external to the compression cavity 10*b,* and the valve rod 43 seals the inlet 41 a of the passage so as to block the path of the inlet path 42 of the valve body 4*a* and the outlet path 41. That is the second gas supplier 5 stops delivery air. At this instance, the user can mount the balloon 7 onto the nozzle 3 for balloon-inflation.

Figure 4:
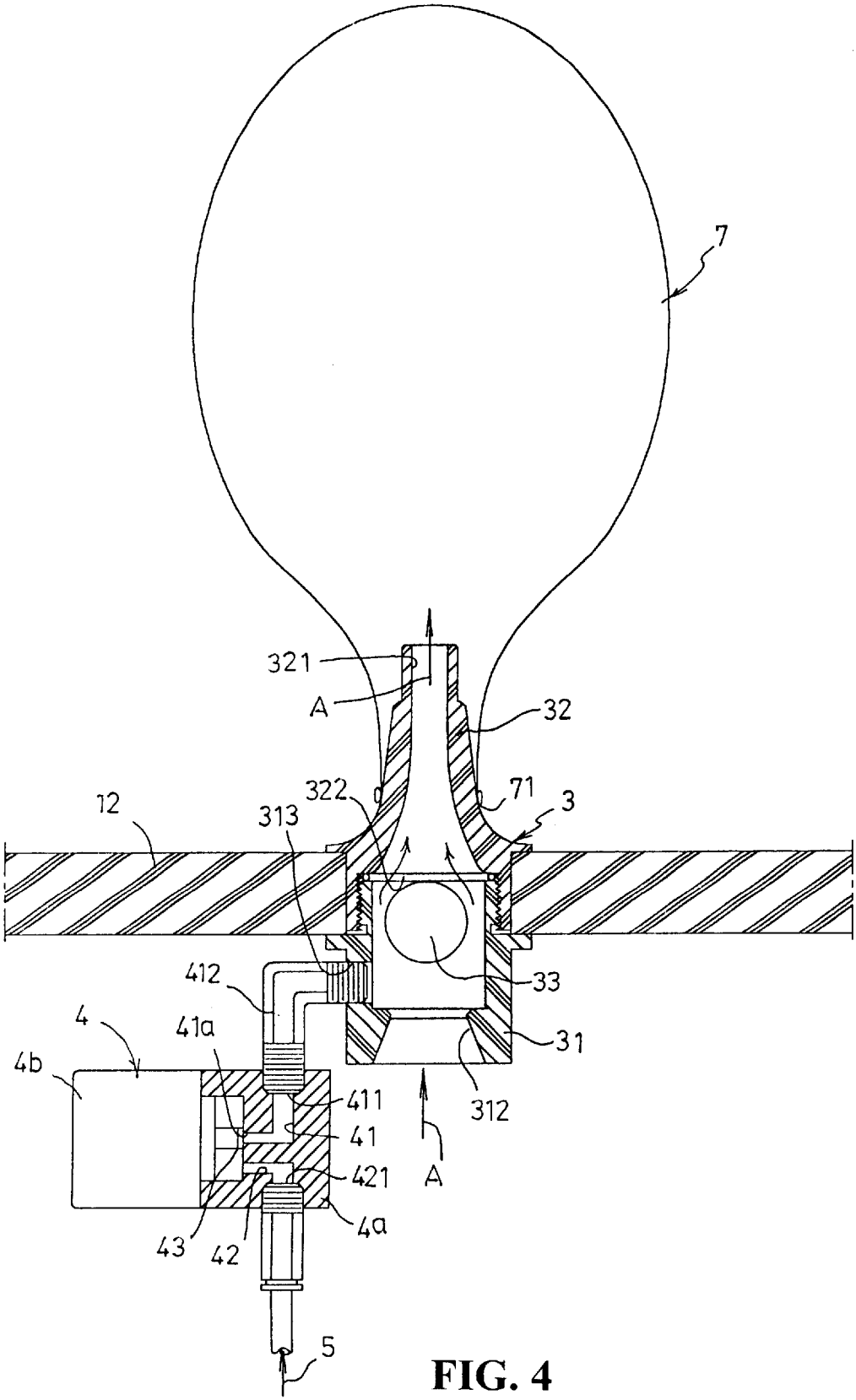
FIG. 4 is a schematic view showing balloon inflation by an air pump in accordance with the present invention.

As shown in FIGS. 1 and 4, if a balloon 7 is to be inflated with air A, the switch 62 of the control device 6 is positioned at OFF to cut off current supply to the second gas supply valve 4 and the valve rod 43 seals the path of the inlet 41*a* of the air-outlet path of the valve body 4*a* to block the communication between the air-inlet path 42 and the air-outlet path 41. The entire second gas supplier 5 stops delivery air to the balloon 7.

Next, the air pump regulator 65 and the timer 64 are adjusted to an appropriate position to preset the power and the time of inflation. Next, turn on the moving switch 63 to initiate the air pump 2 and the timer 64. The air is then compressed to enter the compression cavity 10*b* and the air A moves via the air inlet 312 of the nozzle 3 to urge the stopper 33 and enters the balloon 7. When the timing set by the timer 64 is reached, the air pump 2 stops.

Figure 5:
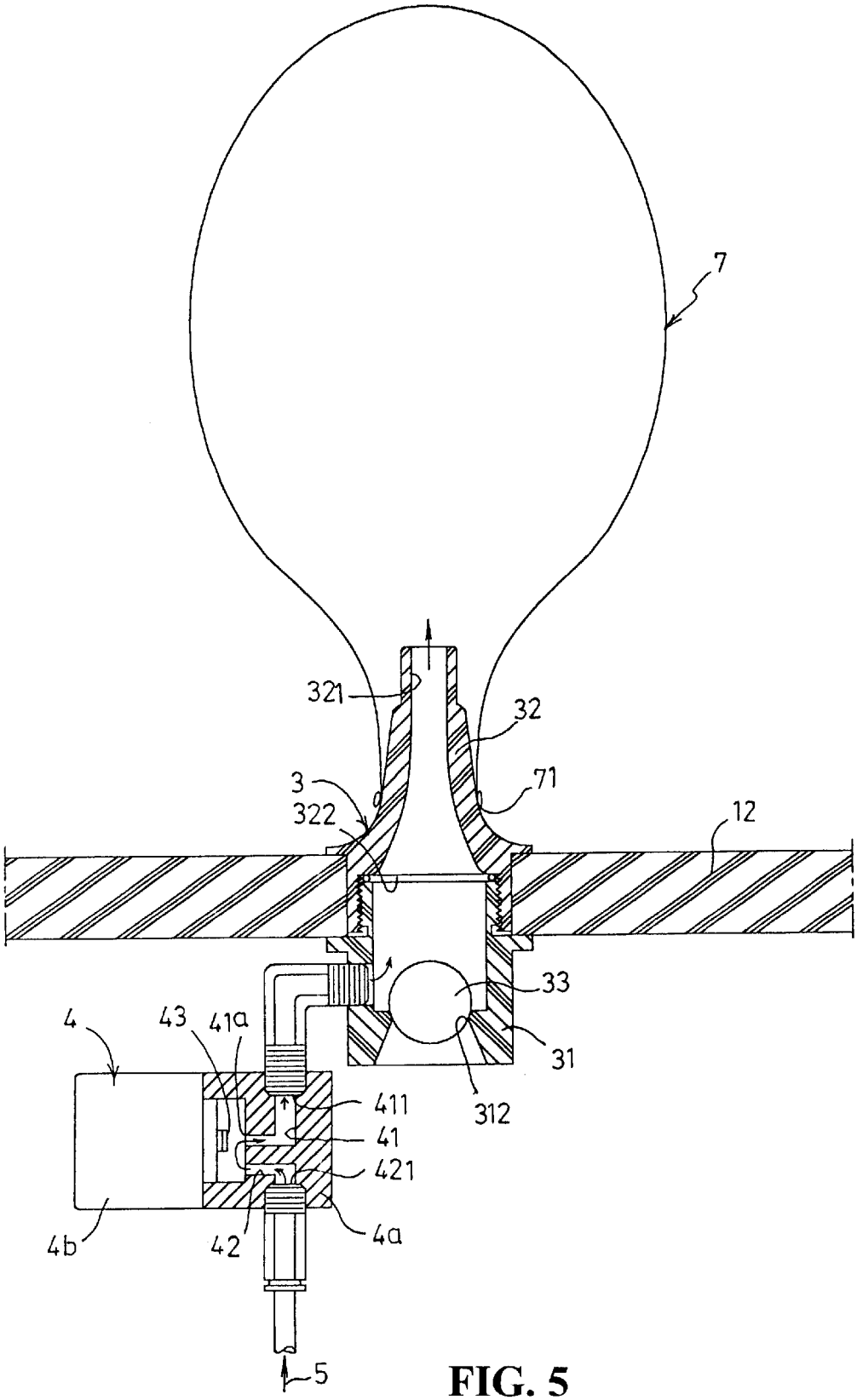
FIG. 5 is a schematic view showing balloon inflation by a gas supplied by a second gas supplier in accordance with the present invention.

Referring to FIGS. 1 and 5, if a second gas is to be used to inflate the balloon 7, for instance, hydrogen gas, the switch 62 is turned to ON position to supply power to the air supply valve 4 and the air pump regulator 65 is adjusted to OFF. The throttle valve 45 is used to adjust the output pressure of the supplier 5. The timer 64 is adjusted to set inflation time. When the moving switch 63 or 63' is pressed, the valve rod 43 is triggered and move backward to open the inlet 41*a* of the air-outlet path of the valve body 4*a,* that is, the path between the air-inlet path 42 and the air-outlet path 41 is in communication. Then, the second gas supplier 5 provides gas to the balloon 7 via the nozzle 3. The timer 64 is initiated until the inflation time. That is, the air valve 4 is triggered to cause the valve rod 43 to restore to its inlet 41*a* and the inflation of the balloon 7 is completed. In the above, the pressure of the compression cavity 10*b* is smaller than that of the nozzle 3, the stopper 33 is closely adhered to the top of the air inlet 312 of the nozzle 3 to stop the gas of the supplier 5 to enter the compression cavity 10*b* of the body 1 via the air inlet 312.

Figure 6:
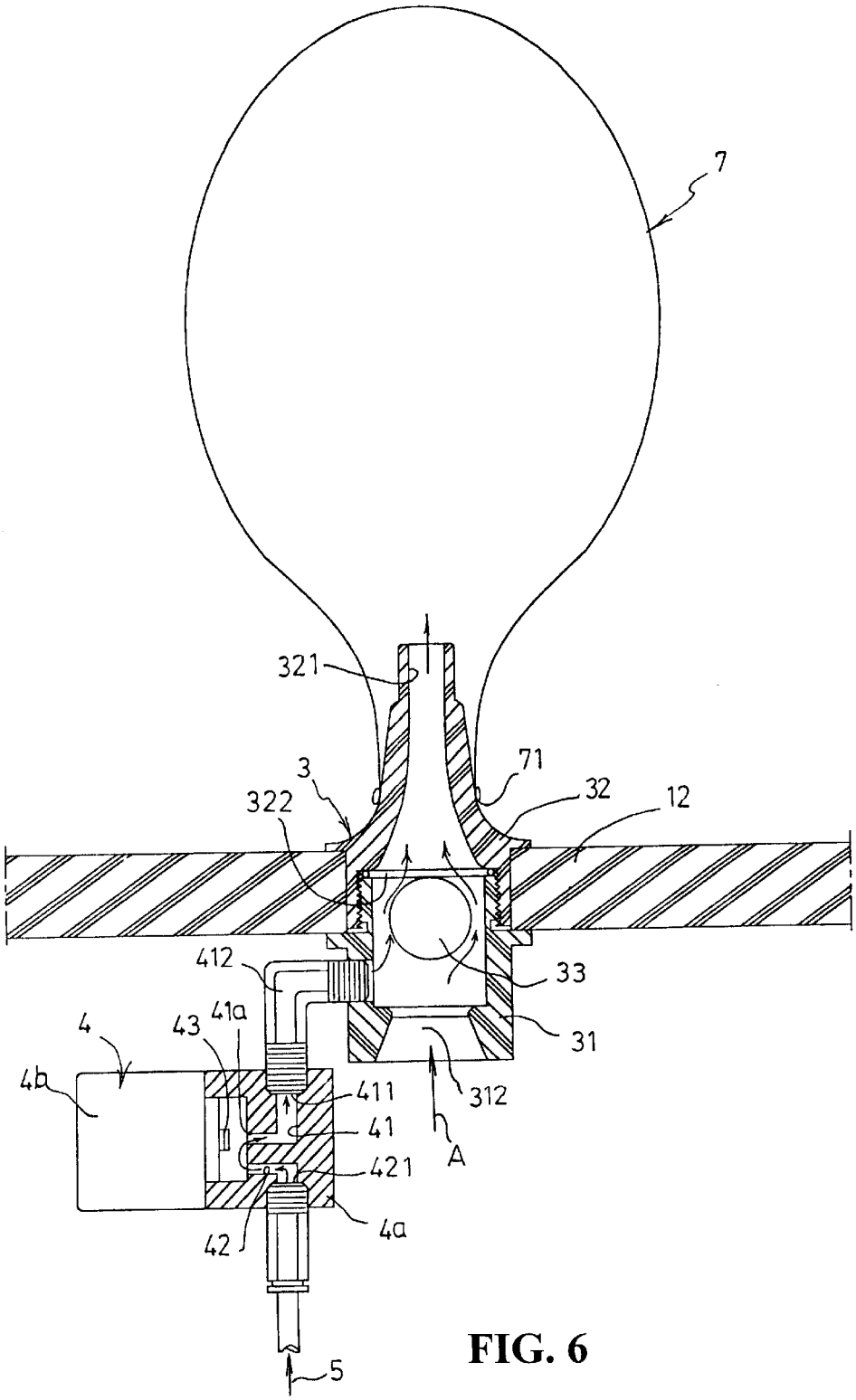
FIG. 6 is a schematic view showing the balloon-inflation with a mixed gas in accordance with the present invention.

Referring to FIGS. 1 and 6, if the balloon 7 is to be filled with a mixed air and gas from the second gas supplier 5, the main switch 61 of the control device 6 is turned on and the switch 62 is positioned at ON position to supply power to the air valve 4. The throttle valve 45 adjusts the output pressure of the supplier 5 and the timer 64 is adjusted to provide with inflation time. The air pump regulator 65 of the control device 6 is adjusted to provide with an appropriate power output. When the moving switch 63 or 63' is pressed, the air pump 2 is initiated and air A from the atmosphere is drawn into the balloon 7 via the air inlet 312 of the nozzle 3.

The valve rod 43 of the valve 4 is triggered and moves backward to open the inlet 41*a* of the air-outlet path of the valve body 4*a.* That is the path between the air-inlet path 42 and the air-outlet path is in communication. The gas from the second gas supplier 5 is delivered to the balloon 7 via the nozzle 3 and the timer 64 is initiated. When the preset air inflation time has been attained, the valve rod 43 is triggered and seals the inlet 41*a.* At the same time, the air pump 2 stops.

In accordance with the present invention, the main power switch 61 is a multi stages switch. When the switch 61 is at the first position, the circuit of the balloon-inflation device is cut off. When the switch 61 is at the second position, the air pump 2 is initiated to pump air and air is directly pumped out via the nozzle 3 continuously. When the switch 61 is at the third position, the switch 62 and the moving switch 63 have to be operated in order to proceed with air inflation.

While the invention has been described with respect to preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. A balloon-inflating device capable of mixing a multiple type of gases, the device comprising:

(a) a body having an air-inlet cavity and a compression cavity;

(b) at least one air pump mounted to the body to pump air from the air-inlet cavity to the compression cavity;

(c) at least an air nozzle mounted to the body and having an air-inlet connected to the compression cavity, wherein the nozzle is provided with a stopper to seal the air-inlet in normal operating condition;

(d) at least a gas supply valve having an air-outlet connected to the air nozzle and having an air-inlet connected to a second gas supplier; and (e) a control device for controlling the operation of the air pump and the gas supply valve;

wherein the body includes a hollow cylindrical body having a partition board positioned at the center thereof to divide the cylindrical body into the air-inlet cavity and the compression cavity, at least an air-inlet hole being provided at the circumferential edge of the air-inlet cavity corresponding to the hollow cylindrical body to lead the external air; and a top cover to sealingly fasten an opening at the top of the hollow cylindrical body;

whereby the opening and closing of the air pump and the gas supply valve inflate a balloon with either air or a gas, or a mixture of the compressed air of the air pump and the gas.

2. The balloon-inflating device of claim 1, wherein the air nozzle includes a base seat mounted across a bottom end of the top cover, and a recess being formed at a downward-facing shaft of the top end, and an air-inlet passed through the recess and a screw hole being provided to the circumferential edge of a bottom seat;

a top nozzle section having a bottom end mounted across the top cover and tightly fastened to the top section of the bottom seat, a communication hole being provided at the top nozzle section so as to communicate with the air inlet of the bottom seat; and a stopper mounted across the bottom section of the recess to seal the top end of the air-inlet so as to block the air from the second gas supplier connected to the second gas supply valve from entering the compression cavity.

3. The balloon-inflating device of claim 2, wherein the bottom end of a communication hole of the top nozzle section has a blocking peg to block the stopper from sealing the communication hole.

4. The balloon-inflating device of claim 3, wherein the second gas supply valve includes a valve body having an air-outlet path through the center thereof, the air-outlet connected to a connector so as to join a screw hole at the base seat of the air nozzle, and an air-inlet path being provided to the valve body, the air-inlet being connected to a connecting head so as to connect to the second gas supplier; and an electromagnetic valve sealingly mounted at a lateral side of the valve body, the electromagnetic valve having a valve rod with a front end sealingly mounted to the inlet of the air-outlet passage to block the path between the air-inlet path of the valve body and the air-outlet path of the valve body.

* * * * *